United States Patent [19]

Bruckner et al.

[11] 3,979,115

[45] Sept. 7, 1976

[54] SHEET LOCK FOR FEED TABLE IN PRINTING PRESS

[75] Inventors: Carl-Heinz Bruckner, Bensheim-Auerbach; Claus Simeth, Offenbach am Main, both of Germany

[73] Assignee: Roland Offsetmaschinenfabrik Faber & Schleicher AG, Germany

[22] Filed: June 19, 1975

[21] Appl. No.: 588,226

Related U.S. Application Data

[63] Continuation-in-part of Ser. No. 570,265, April 21, 1975, abandoned.

[52] U.S. Cl. ..... 271/261; 271/227; 271/229; 271/237

[51] Int. Cl.[2] ..... B65H 7/14; B65H 7/08

[58] Field of Search ..... 271/261, 229, 230, 227, 271/237, 256, 228

[56] References Cited

UNITED STATES PATENTS

| | | | |
|---|---|---|---|
| 2,072,235 | 3/1937 | Wormser | 271/261 |
| 2,708,405 | 5/1955 | Gegenheimer | 271/261 X |

FOREIGN PATENTS OR APPLICATIONS

| | | | |
|---|---|---|---|
| 667,829 | 10/1938 | Germany | 271/261 |

*Primary Examiner*—John J. Love
*Assistant Examiner*—Bruce H. Stoner, Jr.
*Attorney, Agent, or Firm*—Leydig, Voit, Osann, Mayer & Holt, Ltd.

[57] ABSTRACT

A device for interrupting the feeding of sheets to a sheet-fed printing press. A feed table is provided having stops to define the registered position of successively fed sheets. After a register interval during which the sheet settles against the stops the sheet is picked up by a gripper cylinder. Photocells are provided for detecting failure of a sheet to register during the register interval. The photocells energize a retaining device on the feed table having a retaining foot which presses downwardly against the non-registered sheet to prevent such sheet from being picked up by the gripper cylinder. A device providing a time delay is interposed ahead of the retaining device to delay operation of the retaining device for a brief time interval to insure that the preceding sheet picked up by the gripper cylinder is clear of the feed table. A latch is provided to maintain the foot in pressing engagement with the sheet, but the foot is resiliently mounted so that an offending sheet may be manually removed. In certain of the embodiments of the invention removal is limited to drawing the sheet in a direction opposite to the direction of normal flow.

14 Claims, 11 Drawing Figures

(PC NORMALLY "ON")

fig.7.
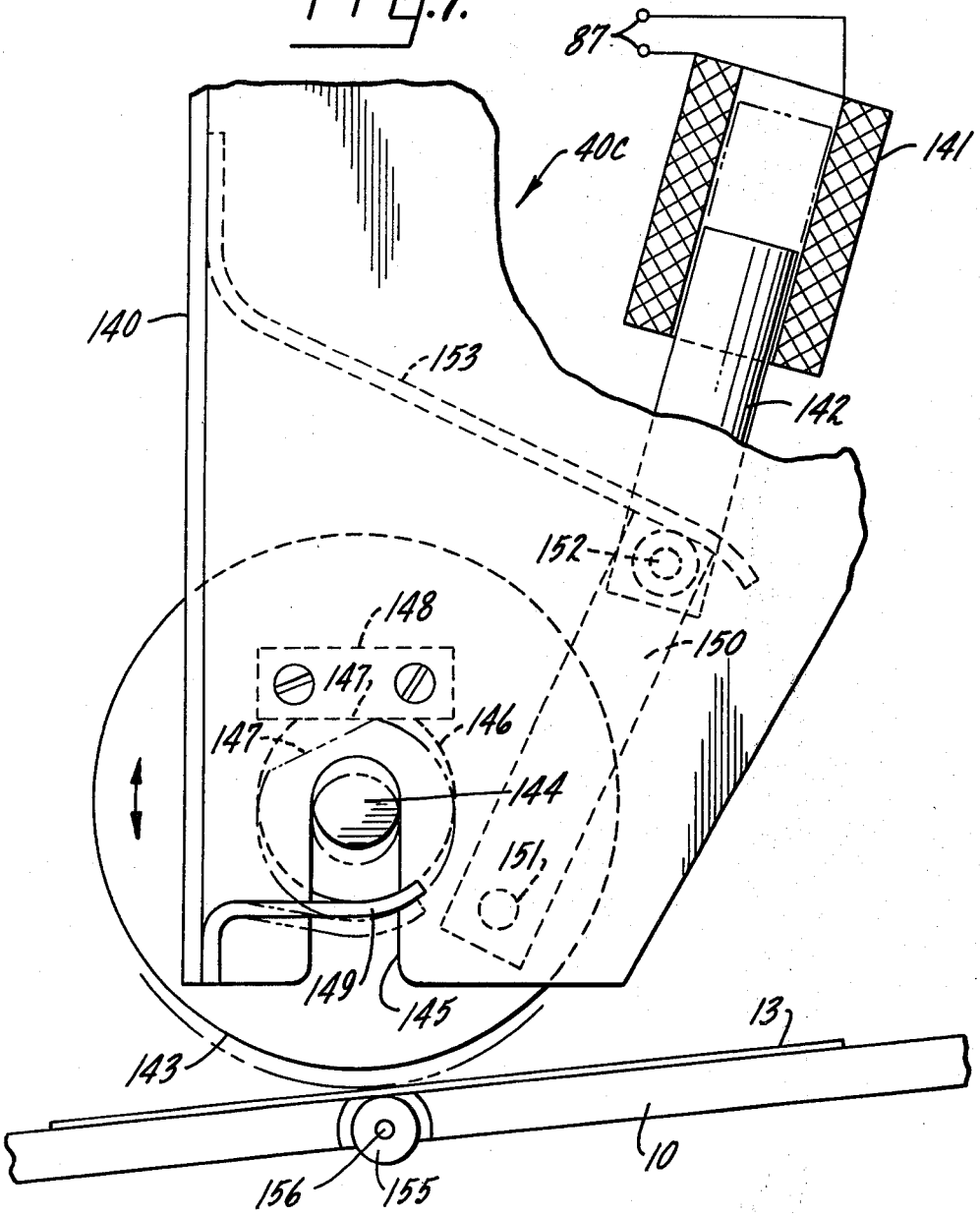
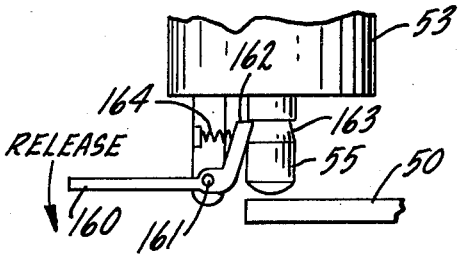
fig.8.
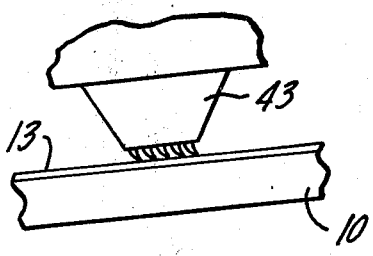
fig.9.

SHEET LOCK FOR FEED TABLE IN PRINTING PRESS

This application is a continuation-in-part of our application Ser. No. 570,265 filed Apr. 21, 1975, now abandoned, entitled Sheet Lock.

In a sheet-fed printing press, particularly of the lithographic type, sheets are fed in succession across a feed table which is adjacent a gripper cylinder. The feed table is equipped with stops for registering a sheet so that it is picked up by the gripper cylinder in a precise position of register.

It some times occurs that a sheet will not take its intended position against the stops and such sheet is therefore not properly gripped so that the image is not accurately positioned on the sheet, thereby spoiling the printed copy. Indeed, if the sheet is sufficiently out of register when it is gripped it may even produce an incipient jamming condition.

Efforts have been made in the past to detect the condition of misregister and to hold back the offending sheet. Typical prior art devices are shown in German Pat. Nos. 543,118 and 667,829 in which misregister is detected by sounding pins which fall into registering openings in the feed table. Movement of a sounding pin is utilized to trip a mechanical or electrical device to shut off the printing press, and continued feeding of the sheets is interrupted by the sounding pins or by brake shoes. The prior devices do not insure retention of sheets that are already on the feed table so that when the press is started up again, an incorrectly fed sheet, or several collected sheets, may pass into the press resulting in damage.

A further problem with the prior devices of the sounding pin type is that such devices are rather crude and non-responsive to small amounts of misregister. Also the prior devices are not effective in stopping sheets which tend to over-shoot. Moreover prior devices of this type generally require the shutting down and restarting of the press which results in loss of production.

It is, therefore, an object of the invention to provide a sheet locking system for a feed table which is accurate and reliable in operation and which permits a poorly registered or over-shooting sheet to be positively stopped and removed by hand by the operator without necessity for shutting down the entire press.

It is another object of the present invention to provide a sheet lock having detecting means to detect the condition of misregister during a registering interval nd which incorporates time delay so that the sheet retaining means at the feed table does not operate immediately to insure that the preceding sheet picked up the gripper is safely clear of the feed table.

It is still another object of the present invention to provide, in a system of this kind, a retaining device having a resiliently pressed foot for engaging the misregistered sheet which is capable of reliably retaining the sheet against pick-up by the gripper cylinder but which nonetheless permits the sheet to be manually removed, preferably by drawing it in a direction opposite to the direction of normal travel. It is one of the aspects of the present invention to provide a retaining device having a foot which upon energization and engagement with a sheet imparts a wiping action to the sheet for moving the sheet backwardly with respect to the direction of normal travel and away from the region of pick-up.

Other objects and advantages of the invention will become apparent upon reading the attached detailed description and upon reference to the drawings in which.

Figure 4:
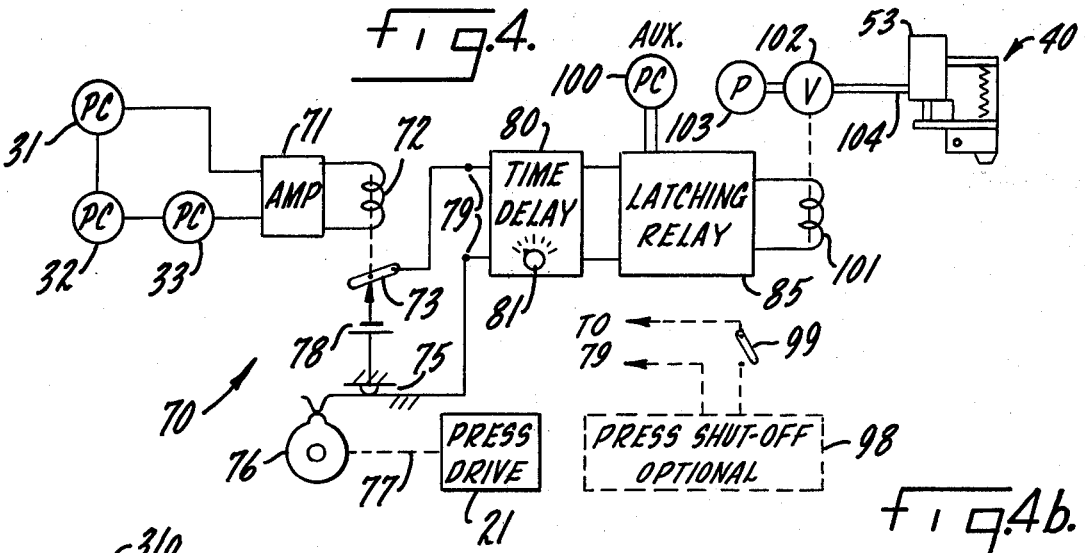
FIG. 4 is a simplified schematic diagram of a control circuit relating the photocells of FIG. 2 with the retaining device of FIG. 3.
Figure 4A:
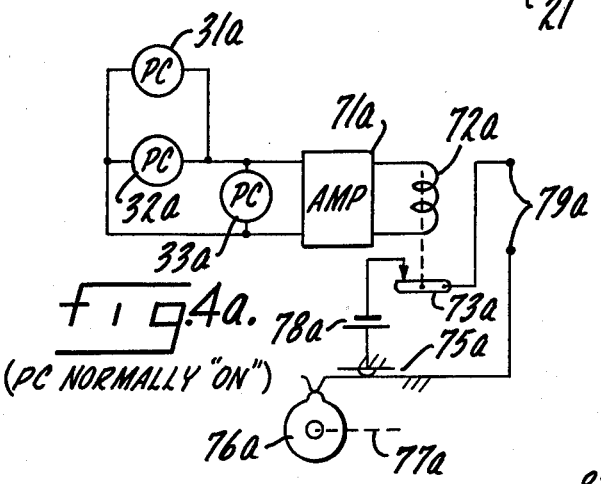
Figure 4B:
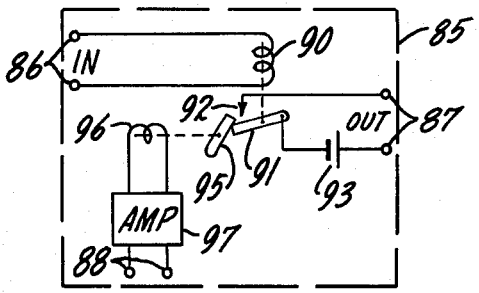

FIG. 4*a* is a fragmentary schematic diagram showing an alternate photocell connection, while FIG. 4*b* shows a latching relay.

Figure 5:
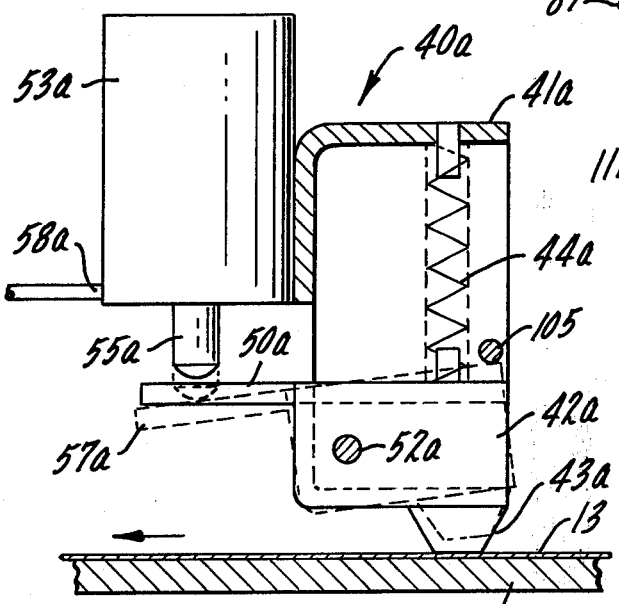

FIG. 5 shows a second embodiment of sheet locking device usable in practicing the present invention.

Figure 6:
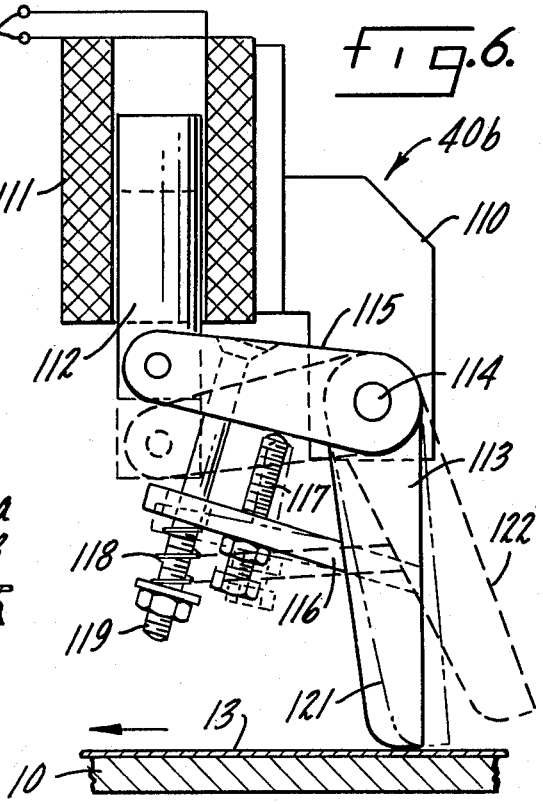

FIG. 6 shows a further form of sheet locking device which insures that a sheet is retracted upon manual removal.

FIG. 7 is a still further form of sheet locking device capable of imparting a wiping retrograde motion to the sheet as it is engaged.

Figure 3:
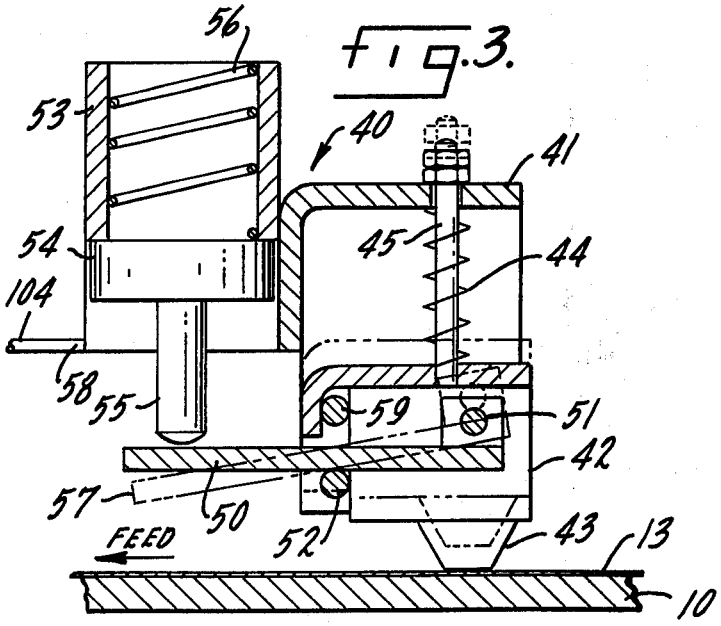
FIG. 3 shows one embodiment of sheet locking device including a spring pressed foot and a pneumatic cylinder for disengaging the foot.

FIG. 8 shows how manual latching may be applied, if desired, to the structure shown in FIGS. 3 and 5.

FIG. 9 shows use of a specially surfaced foot.

While the invention has been described in connection with certain preferred embodiments, it will be understood that we do not intend to be limited to the particular embodiments shown but that we intend, on the contrary, to cover the various alternative and equivalent forms of the invention included within the spirit and scope of the appended claims.

Figure 1:
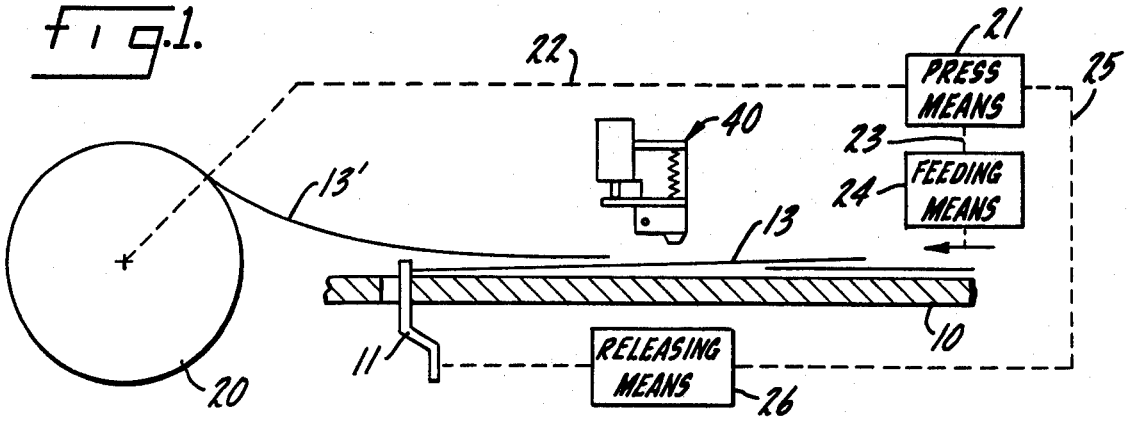
FIG. 1 is a schematic elevation of a feed table, with its associated gripper cylinder, incorporating the present invention.
Figure 2:
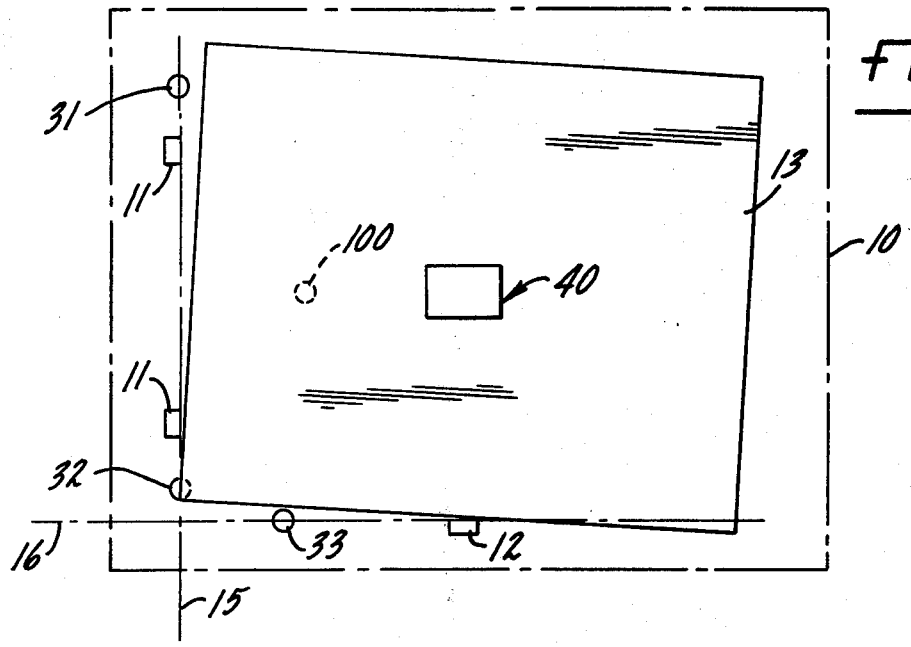
FIG. 2 is a diagram showing the top view of a sheet which is misregistered with respect to front and side stops and showing the location of photocells to detect the misregistered condition.

Turning now to the drawings there is shown in FIGS. 1 and 2 a feed table 10 having a set of front guides 11 and a side guide 12. The purpose of the guides is to register a sheet of paper 13, fed along the table from right to left, into register with a front register axis 15 and a side register axis 16. The sheet is taken from the position of register by a gripper cylinder 20, as is well known in the art, the gripper cylinder serving as a transfer device for feeding the sheet, in accurately registered position, into engagement with the printing rollers of the press. As indicated in FIG. 1, the gripper cylinder 20 is shown in the act of picking up and removing a sheet 13' which precedes the sheet 13 on the table. It will be understood that the printing press, its drive, the means for feeding sheets in succession across the table and the releasing means for the front guides 11 are all conventional and need not be described. However, there is indicated in block form the press drive 21 having a connection 22 to the gripper cylinder, a connection 23 to sheet feeding means 24 and a connection 25 to the releasing means 26 which cylically releases the front guides 11.

For the purpose of detecting a condition of misregister of a sheet a set of photocells is employed including photocells 31, 32 along the front register axis 15 and a photocell 33 along the side register axis 16. Such photocells have, in the past, been employed to shut down a press upon failure of register. However, in accordance with the present invention the photocells are used to activate a retaining device, or organ, mounted above the feed table and having a foot which, upon energization, presses resiliently against the misregistered sheet to prevent it from being fed to the gripper cylinder 20, with time delay means interposed between the photocells and the retaining means to insure that the preceding sheet picked up by the gripper cylinder is clear of the feed table, the retained sheet being held until manually removed by the press operator by pulling in the upstream direction, that is, a direction opposite to the normal direction of feed. More specifically in accordance with the invention means are provided for "enabling" the control function of the photocells during a predetermined "register interval" in the cycle and for latching the retaining means until the offending sheet has been safely removed. The present invention enables the immobilized sheet to be so quickly removed from the table that, in most cases, normal press operation can continue without necessity for shut down of the press.

Referring to FIGS. 3 and 4 there is shown a typical retaining device and control circuit which may be employed in the practice of the invention. The retaining device, indicated at 40 includes a frame 41 which may be secured above the table 10 by any suitable support or bracket. Mounted for vertical movement in the frame 41 is a slide 42 having a foot 43. The slide and foot are biased downwardly into a sheet engaging position by means of a biasing spring 44 surrounding a plunger 45. For raising and lowering the slide a lever 50 is provided pivoted to the slide by a pivot pin 51 and fulcrummed on a transversely extending pin 52 mounted in the frame. Operating upon the left-hand end of the lever 50 is a pneumatic actuator 53 having a piston 54 which operates a plunger 55. The spring 56 normally disengages the device 40 by pressing the piston 54 into a downwardly bottomed condition in which the lever 50 is rocked counterclockwise about the pivot 52 to the dot-dash position 57. For the purpose of overcoming the actuator spring 56 pressurized air is admitted under the piston through an inlet opening 58. This, as illustrated, raises the plunger 55 clear of the lever 50 so that biasing spring 44 is free to press the foot 43 against the sheet.

It is one of the features of the construction illustrated in FIG. 3 that the slide 42 is guided for straight up and down movement in response to the actuator 53, such guidance being provided by a pin 59 transversely arranged in the frame 41. The pure reciprocating movement as the foot 43 is lowered into engagement with the sheet insures that the sheet will not, by reason of the engagement, be nudged in the forward direction indicated by the arrow, that is, in the direction of the zone of pick-up of the cylinder 20. It is, moreover, one of the features of the illustrated construction that the slide 42 may nonetheless cockingly yield as the offending sheet 13 is drawn out from under the spring-pressed foot 43 in a direction opposite to the direction of flow, the cocking movement taking place in the counterclockwise direction with the guide pin 59 acting as a temporary pivot. It is to be noted that the pin 59 about which the cocking movement takes place during release of a sheet is on the downstream side of the foot 43, thereby making it easy to manually withdraw a sheet for release in the upstream direction using only light manual pressure while making it difficult to release the sheet by drawing it in the downstream direction. It is convenient to consider the foot 43 as a cam surface eccentrically positioned on the upstream side of the temporary pivot pin 59, with the cam surface tending to be disengaged by upstream movement of the sheet but more tightly engaged by any attempt to move the sheet downstream.

Having understood one embodiment of the retaining means, attention may next be given to the control circuit therefor which is set forth at 70 in FIG. 4 and which derives its input signal from the photocells 31–33. It will be appreciated that photocells may be arranged to respond to light or to absence of light. It will be assumed, simply by way of example, that the photocells 31–33 are normally deenergized and are "turned on", or become conductive, only when a sheet is in registered position. The three photocells, functionally connected in series, are connected to an amplifier 71 which feeds a relay 72 having normally closed contacts 73. Thus during a condition of misregister, when any one, or all, of the photocells are deenergized, the relay 72 will be deenergized and the relay contact 73 will be closed. It will be understood that while a relay is shown, it is simply symbolic and in a practical circuit solid state elements are employed.

The condition of register only occurs intermittently, during a "register interval", even during normal operation of a feed table and press; consequently, means are provided for determining the presence or absence of the condition of register only during such register interval. In short, means are provided for "enabling" the photocells to send a signal indicative of a condition of misregister only during that time, that is, during the register interval, in which misregister has significance. Thus we provide an "enabling" switch 75 which is operated by a cam 76 having a connection 77 with the press drive 21. A source of voltage 78 is included in the circuit. The cam 76 is so phased that the switch 75 is closed only during the interval that register is supposed to be taking place. Thus during normal operation of the press each sheet, during the register interval, will be in registered position thereby turning on all three of the photocells 31–33 and energizing the relay 72 so that no signal will exist across the output terminals 79 of the detector circuit, and the retaining device 40 will not be operated. However, if any one of the photocells 31–33 fails to turn on during the register interval, indicating a condition of misregister, the contacts 73 will be closed during the register interval and a misregister signal thus will appear at the terminals 79.

In carrying out the invention a time delay device 80 is interposed in the circuit so that the retaining device 40 does not go into its clamping mode immediately but only after a time delay which is adequate to insure that the preceding sheet (13' in FIG. 1) clears the feed table. The time delay device 80 may be a commercially available unit having provision 81 for adjustment and calibrated in terms of fractions of a second.

In accordance with one of the aspects of the present invention means are provided for responding to a momentary signal at the detector terminals 79 to initiate operation of the retaining device 40 and for temporarily latching the retaining device in its activated condition until the offending sheet can be manually removed from the feed table. Such response to a momentary signal, with subsequent latching, is conveniently provided by a latching relay 85. While latching relays are per se known, a typical construction has been set forth, for sake of completeness, in FIG. 4*b*. Here the relay will be seen to have input terminals 86, output terminals 87 and release terminals 88. The input terminals are connected to a relay 90 having an armature 91. The armature controls a set of normally open contacts 92 which are connected, in series with a source of voltage 93 to the output contacts 87. For holding the armature 91 "latched in", a latch 95 is provided releasable by an electromagnet 96 fed by an amplifier 97 from the release terminals. Preferably the release terminals are controlled by an auxiliary photocell 100 which is so arranged that the electromagnet 96 is deenergized as long as the offending sheet 13 is in position but energized when the offending sheet is manually removed. In order that the latch 90 and retaining device 40 might be released as promptly as possible upon manual removal of the misregistered sheet in the upstream direction, the auxiliary photocell 100 may be located, as shown in FIG. 2, on the table adjacent the leading edge of the sheet.

For energizing the pneumatic cylinder 53 the output terminals of the latching relay are connected to an electromagnet 101 which controls air valve 102 for admitting air from a source of pressure 103 to the air cylinder via a line 104 and for venting the line.

With the typical control circuit in mind, the operation of the device, upon misregister of a sheet 13, may be summarized as follows: Failure of sheet 13 to be alined with the register axes 15, 16, as illustrated in FIG. 2, will cause all or a portion of the photocells 31–33 to fail to turn on, thereby causing the photocell output contacts 73 to remain closed. The subsequent momentary closure of contacts 75 during the register interval causes a momentary signal to be applied to the time delay device 80 which, a fraction of a second later, energizes the latching relay to turn on the electromagnet air valve 101, 102 which admits air to the pneumatic cylinder 53, raising the piston 54 against the force of spring 56 and allowing the retaining foot 43 (FIG. 3) to descend into engagement with the sheet 13 resiliently under the influence of the downward biasing spring 44. The foot 43 remains in contact with the sheet because of the latching so that the sheet is blocked against further movement in the direction of the gripper cylinder. Noting that the retaining device 40 has been triggered, the operator grasps the immobile sheet 13, drawing it from under the foot 43 in the upstream direction, with the foot 43 yielding against the force of the spring 44 accompanied by slight cocking of the slide 42 so that only a light manual force is required to remove the sheet. As soon as the leading edge of the sheet is retracted beyond the auxiliary photocell 100, the auxiliary photocell sends a releasing signal via amplifier 97 to electromagnet 96 which retracts the latch 95 thereby releasing the relay armature 91 and opening the output circuit. This opening of the circuit deenergizes the electromagnet valve 101, 102 to cut off the pressure and to vent line 104 so that the piston 54 in the retaining device is moved downwardly under the influence of spring 56, tilting the lever 50, and raising the foot 43 to dot-dash position clear of the table so that normal feeding of sheets into registered position may resume.

While the operation of the control circuit has been described in connection with photocells which are turned on to indicate a condition of register, the invention is equally applicable to photocells which are turned off as illustrated in FIG. 4*a* where corresponding elements are indicated by corresponding reference numerals with addition of subscript *a*. In such version of the invention the photocells 31*a*–33*a* are connected in parallel to control a relay 72*a* having a normally open contact 73*a*. In this version, with the photocells 31*a*–33*a* normally energized, the condition of register causes all of the photocells to be turned off thereby opening contacts 73*a* so that no misregister signal is sent during the register interval and the control circuit does not operate. However, upon failure of any one of the photocells to be turned off, indicative of the condition of misregister, the relay 72*a* will fail to open contacts 73*a* during the register interval and a misregister signal will thus appear at terminals 79*a* to trigger the misregister sequence described above.

In the described sequence the auxiliary photocell 100 is employed to automatically release the latching relay. However, such automatic release is not essential to achieving the benefits of the invention and, if desired, a manual release push button may be connected across the release terminals 88 of the latching relay, with a voltage source.

While it is one of the features of the present system that misregistered sheets may be retrieved without stopping the press, it is nevertheless a feature of the circuit that the misregister signal from the photocells may be used to shut the press down. The usual emergency shut off circuit, indicated at 98, may be connected across the photocell signalling terminals 79 with a selector switch 99 connected in series.

While the operation has been described in connection with the retaining unit shown in FIG. 3, the invention may be practiced with advantage using the modified unit 40*a* illustrated in FIG. 5 where similar elements have been given similar reference numerals. In this version instead of employing a slide with straight line movement, the foot 43*a* is mounted directly upon the right-hand end of the lever 50*a*. The device, as illustrated by the full lines, is in the energized state with pressure being applied at the port 58*a* and with the foot 43*a* pressed resiliently against the sheet 13 by the biasing spring 44*a*. Under such circumstances the sheet may be retrieved by drawing it upstream (to the right) which will be accompanied by slight cocking of the lever 50*a* against the force of the biasing spring. Because of the position of the fulcrum 52*a*, downstream from the foot, withdrawal of the sheet 13 in the downstream direction is more difficult and is thereby discouraged. A stop 105 limits the degree of swing of the lever 50*a*.

FIG. 6 illustrates a still further form of the present invention in which the pneumatic actuator is replaced by a solenoid and in which the foot geometry and pivot point are such as to make it practically impossible to withdraw a misregistered sheet except in the upstream direction. In this version, generally indicated at 40*b*, there is a frame 110 which supports a solenoid 111 having an armature 112, the solenoid winding being connected to the terminals 87 of the latching relay (FIG. 4). The foot which engages the sheet 13 is in the form of a vertically extensive arm, or cam, 113 having a pivot point 114 which is just slightly downstream from the region of contact of the arm with the sheet. Also pivoted for swinging movement about the pivot 114 is an actuating arm 115 which is connected to the lower end of the armature 112. For coupling together the arms 113, 115, the arm 113 is fitted with a rigid bracket 116 having an adjustable stop 117. The stop is kept bottomed by a biasing spring 118 surrounding a stud 119 which is secured to the arm 115 and which passes through a clearance opening in the bracket 116.

The device shown in FIG. 6 is illustrated in the energized, or clamping, state with armature 112 sucked in and with the spring 118 compressed so that a clockwise resilient force is applied to the bracket 116 to cam the tip of the arm 113, which acts as a foot, against the misregistered sheet 13. Because of the location of the pivot 114 any attempt to withdraw the sheet 13 in the downstream direction serves to crowd the arm 113 even more tightly against the sheet. Nevertheless, the sheet 13 may be withdrawn in the opposite, or upstream, direction with only light manual force, with the arm 113 yielding to position 121 against the biasing force of the spring 118.

After the offending sheet has been removed, accompanied by release of the latching relay, the solenoid 111 is deenergized causing the arms 113, 115 and connected parts to rotate, under the influence of gravity, to an out of the way position illustrated at 122 for normal feeding of sheets into registered position.

In accordance with one of the more detailed aspects of the invention a retaining device 40*c* may be employed which, similarly to that just described, is powered by a solenoid and which has certain additional advantages. These advantages include the imparting of a slight upstream wiping movement to the sheet 13 as it is engaged plus the fact that a smoothly curved large-radius surface is presented to the table to prevent inadvertent "catching" of a sheet fed normally across the surface of the table. Thus referring to FIG. 7, the device 40*c* includes a frame 140 mounting a solenoid 141 having an armature 142. The foot, in this version, is in the form of a disc, or disc segment, 143 having a central shaft 144 which rides in a vertical slot 145. Centered on the shaft is a circular cam surface 146 having a flat 147 which rests against the presented flat edge of an abutment 148. The disc 143 is urged upwardly by means of a spring 149 to normally urge the "flat" 147 into contact with the abutment.

For the purpose of rotating the disc counterclockwise and for simultaneously lowering it against the sheet, a connecting rod 150 is provided having a first pivot connection 151 with a disc and a second pivot connection 152 with the solenoid armature. A return spring 153, bearing downwardly upon the pin 152, biases the parts into the condition shown by the full lines.

When the winding of the solenoid 141 is energized by the latching relay 90 the disc 143 rotates counterclockwise causing the "flat" 147 to tilt in the direction shown so that the corner of the flat, reacting against the abutment 148, cams the disc downwardly, causing the shaft 144 to move downwardly in the slot 145 against the restoring pressure of the spring 149.

As a result the lower edge of the disc 143, which functions as a foot, is brought into contact with the misregistered sheet 13 with a wiping engagement so that the sheet is not only clamped against the table, but as it is being clamped it is moved slightly in the upstream direction, that is, in a direction away from the region of the grippers on the gripper cylinder 20. To facilitate this translatory movement a roller 155 mounted upon a pin 156 may be embedded in the table 10 in a position vertically alined with the shaft 144 of the disc.

In the version shown in FIG. 7 additional resilience may be incorporated by mounting the abutment 148 resiliently, as contrasted with fixedly, upon the frame 140. Preferably, where the abutment 148 is fixed, the geometry is such that the full diameter of the cam 146 is not presented to the abutment. In a simplified version similar to that illustrated in FIG. 7 the disc may be replaced by a snail-like segment of cam mounted for rotation about a fixed shaft and with the solenoid serving to bring the "high" of the cam surface progressively into engagement with the sheet 13 with wiping action.

It will therefore be seen that each of the retaining devices illustrated in FIGS. 3, 5, 6 and 7, has individual merits and use is a matter of preference. Each of the versions produces reliable clamping of a misregistered sheet against the feed table, preventing such sheet from being fed into the press, following a sufficient time delay to insure that it is the misregistered sheet which is clamped without interfering with the tail of the preceding sheet. The retaining device is latched in its clamped position long enough for the press operator to retrieve the sheet, following which the retaining means is released either automatically, as described, or by manual means. Instead of employing an electrical, or solid state, latching device, latching may be mechanical without departing from the invention. As shown fragmentarily in FIG. 8 a mechanical latch 160 may be used, pivoted at 161 and having a tip 162 engaging an annular groove 163 on the plunger 55 of the pneumatic actuator. The latch is biased into latching condition by a spring 164. Even a momentary misregister signal from the photocells, without necessity for latching relay 90, suffices to give a shot of air to the pneumatic cylinder, sucking the plunger 55 into its upraised position enabling the tip of the latch 162 to snap into place. The operator can then retrieve the sheet, as described in connection with FIGS. 3 and 5, by pulling it in the upstream direction, following which a touch on the latch arm 160 serves to drop the plunger under the influence of the return spring (56) to retract the retaining device for continued normal operation of the press.

In the above discussion it has been assumed that the foot which engages the sheet is smoothly surfaced. However, if desired the foot 43 may be surfaced, as illustrated in FIG. 9, with resilient material in saw-tooth pattern, oriented as shown, to facilitate pulling a sheet in the upstream direction for removal while inhibiting any motion of the sheet in the downstream direction. If desired, the time delay 80 may be omitted and time delay may be secured by interposing a one-way throttling restriction preferably adjustable, in the air line 104. Or the time delay may be that which is inherent in the response of the control circuit elements.

While the photocell "enabling" means in the form of switch 75 has been shown as synchronized with the press drive, the term "drive" will be understood to be a general term and the photocells may, in accordance with the invention, be enabled by whatever "drive" means is used to deposit sheets individually in the position of register.

What is claimed is:

1. Means for interrupting the feeding of sheets to a sheet-fed printing press comprising, in combination, a press drive, a feed table, means defining a registered position of a sheet thereon, means coupled to the drive for feeding sheets across the feed table in succession into engagement with the registering means, a gripper cylinder, said gripper cylinder being coupled to the drive for picking up successive sheets following register intervals, retaining means having a retaining foot spaced opposite a sheet on the feed table and having provision for energization to press the foot downwardly against the sheet to immobilize the sheet so that it is not picked up by the cylinder, means for detecting failure of register of a sheet during a register interval for energizing the retaining means, time delay means interposed between the detecting means and the sheet retaining means to delay operation of the retaining means thereby to insure that the preceding sheet picked up by the gripper cylinder is clear of the feed table so that the foot presses downwardly upon the non-registered sheet, and means for permitting manual removal of the non-registered sheet from below the foot.

2. The combination as claimed in claim 1 in which the retaining means includes a shiftable member for mounting the foot and in which a resilient biasing spring is provided for biasing the foot in the direction of the table, the yielding of the biasing spring in the face of upwardly applied manual force permitting a non-registered sheet to be manually withdrawn from under the foot while the retaining means is in its energized condition.

3. The combination as claimed in claim 2 in which the retaining means includes a spring-returned pneumatic cylinder operated by the detecting means for overcoming the biasing spring to raise the foot from the table.

4. The combination as claimed in claim 1 in which the retaining means includes a pneumatic cylinder for controlling the position of the foot, the cylinder having a magnetic control valve energized by the detecting means.

5. The combination as claimed in claim 1 in which the retaining means includes an electromagnet for actuating the foot between extended and retracted positions, the electromagnet being energized by the detecting means.

6. The combination as claimed in claim 1 in which the retaining foot is in the form of a pivoted cam, the cam having a pivot axis parallel to the table and having a foot in the form of an eccentric surface presented adjacent the table, means energized by the detector means for rocking the cam to rotate the eccentric surface into contact with a sheet to retain the same, the cam and its rocking means having a resilient return spring connected thereto in opposition to the rocking means to facilitate manual withdrawal of a non-registered sheet from under the foot while the retaining means is in its energized condition.

7. The combination as claimed in claim 1 in which means are provided for maintaining the retaining means latched on until the sheet has been removed.

8. The combination as claimed in claim 1 in which the detecting means includes detectors mounted at a registered edge of the sheet to indicate the absence of register, and means synchronized with the press drive for enabling the detectors only during a register interval while disabling the detectors at all other times.

9. The combination as claimed in claim 1 in which the detecting means includes photocells mounted at a registered edge of the sheet, the output circuit of the photocells being arranged to produce an output signal in the absence of register, means interposed between the photocell output circuit and the retaining means and synchronized with the press drive for enabling the retaining means to be energized in response to the photocell output signal only during the register interval, and means for maintaining the retaining means latched in the energized state until the non-registered sheet is removed.

10. Means for interrupting the feeding of sheets to a sheet-fed printing press comprising, in combination, a press drive, a feed table, means including stops defining a registered position of a sheet on the table, means coupled to the drive for feeding sheets across the table in succession into engagement with the stops to define a register interval during which register takes place, a gripper cylinder, said gripper cylinder being coupled to the drive for picking up successive sheets following the register interval, retaining means having a retaining foot spaced opposite a sheet on the feed table and having provision for energization to press the foot downwardly against the sheet to immobilize the sheet so that it is not picked up by the cylinder, photocells mounted on the table at the edge of the sheet for detecting failure of a sheet to move into registered position, the output circuit of the photocells being arranged to produce an output signal in the absence of register, an enabling switch coupled to the press drive and closed during the register interval for causing the retaining means to be energized in response to the photocell output signal only during the register interval, time delay means responsive to the photocell output signal to delay operation of the retaining means thereby to insure that the preceding sheet picked up by the gripper cylinder is clear of the feed table so that the foot presses downwardly upon the non-registered sheet, means for latching the foot in its downwardly pressed condition for temporarily retaining the sheet, and means permitting manual removal of the non-registered sheet from below the foot to enable resumption of the flow of sheets into registered position.

11. The combination as claimed in claim 1 in which means are provided responsive to operation of the detecting means for disabling the press.

12. The combination as claimed in claim 1 in which the retaining means includes a pivoted member with the pivot being horizontal and transversely arranged with respect to the direction of normal travel of the sheet, the foot of the retaining means being mounted upstream of the pivot so that manual retraction of the sheet during continued energization, and using light manual force, is only possible in a direction opposite to the direction of normal travel and so that a non-registered sheet is, during removal, retracted from the region of pickup.

13. The combination as claimed in claim 1 in which the foot includes means for imparting a wiping action to the sheet as the foot engages the sheet for wiping the sheet backwardly with respect to the direction of normal travel so that a non-registered sheet is retracted from the region of pickup.

14. Means for interrupting the feeding of sheets to a sheet-fed printing press comprising, in combination, a press drive, a feed table, means including stops defining a registered position of a sheet on the table, means coupled to the drive for feeding sheets across the table in succession into engagement with the stops to define a register interval during which register takes place, a gripper cylinder, said gripper cylinder being coupled to the drive for picking up successive sheets following the register interval, retaining means having a retaining foot spaced opposite a sheet on the feed table and having provision for energization to press the foot downwardly against the sheet to immobilize the sheet so that it is not picked up by the cylinder, photocells mounted on the table at the edge of the sheet for detecting failure of a sheet to move into registered position, the output circuit of the photocells being arranged to produce an output signal in the absence of register, enabling means coupled to the press drive and closed during the register interval for causing the retaining means to be energized in response to the photocell output signal only during the register interval, means responsive to the photocell output signal to insure that the preceding sheet picked up by the gripper cylinder is clear of the feed table so that the foot presses downwardly upon the non-registered sheet, means for latching the foot in its downwardly pressed condition for temporarily retaining the sheet, the pressure exerted by the foot being such as to permit manual removal of the non-registered sheet from below the foot by retraction in the upstream direction, and means responsive to the manual retraction of the sheet for releasing the latching means to disengage the foot for resumption of the flow of sheets into registered position.

* * * * *